United States Patent [19]

Bertrand

[11] 4,433,871

[45] Feb. 28, 1984

[54] MACHINE FOR CUTTING CURBSTONES, SIDEWALLS AND THE LIKE

[76] Inventor: Rene Bertrand, 648 Lasalle, St. Jean, Quebec, Canada, J3B 2R2

[21] Appl. No.: 389,572

[22] Filed: Jun. 17, 1982

[51] Int. Cl.[3] ..... E01C 23/09

[52] U.S. Cl. ..... 299/41; 299/15; 299/75; 30/379.5; 83/928; 173/43

[58] Field of Search ..... 299/39, 41, 15, 75; 125/14; 51/180; 30/379.5; 83/488, 489, 928

[56] References Cited

U.S. PATENT DOCUMENTS

| | | | |
|---|---|---|---|
| 2,216,971 | 10/1940 | Farmer | 30/379 |
| 2,845,851 | 8/1958 | Nagin | 299/39 |
| 3,649,071 | 3/1972 | Graff | 299/15 X |
| 3,785,705 | 1/1974 | Binger et al. | 299/15 X |
| 3,815,570 | 6/1974 | Story | 125/14 |
| 4,233,954 | 11/1980 | Visser | 125/14 |
| 4,336,732 | 6/1982 | Liet et al. | 30/379.5 |
| 4,353,275 | 10/1982 | Colville | 83/928 X |
| 4,357,120 | 11/1982 | MacDonald | 83/928 X |

*Primary Examiner*—Ernest R. Purser
*Assistant Examiner*—Beverly E. Hjorth
*Attorney, Agent, or Firm*—Robic, Robic & Associates

[57] ABSTRACT

Machine including a powered truck-like vehicle having a support base at the rear end and an apparatus for cutting a drive-in passage across a concrete curbstone, a sidewalk or the like. The apparatus is mounted on the base and essentially comprises two spaced parallel booms mounted at one end on the base and an elongated bridge structure extending between and perpendicularly to the booms, being connected to them and provided with a drive so that it can be displaced along the booms with respect to the support base of the vehicle. The booms and bridge structure are pivoted from an inoperative position where the bridge structure is above the support base to an operative position where the booms and bridge structure are swung outwardly of the support base in a position for cutting the curbstone, sidewalk or the like. A carrier, having a concrete rotary cutting saw, is mounted on the bridge structure and displaceable in a first direction along one face of the structure, the saw itself being displaceable along a second direction which is perpendicular to the first mentioned direction. In this manner, with the apparatus in the operative position, the rotary saw is first advanced in the second direction through the curbstone, sidewalk or the like and then in the first direction to cut an elongated slot determining the elongated extent of the drive-in passage.

15 Claims, 10 Drawing Figures

MACHINE FOR CUTTING CURBSTONES, SIDEWALLS AND THE LIKE

The present invention relates to a machine in the form of a powered truck-like vehicle at the rear of which is provided an apparatus capable of cutting through concrete curbstones or sidewalks.

The purpose of my invention is to produce, with the apparatus mentioned above, a step through a curbstone or a drive-in ramp through a sidewalk, suitable to allow vehicles, particularly automobiles, to have an easy and smooth access to a drive way leading to a house or other building, either existing or to be constructed. In the case of a curbstone, the step mentioned above is usually horizontal while the ramp through a sidewalk takes on a slight incline of which the angle is normally prescribed by city bylaws. The intent, in both cases, is to provide a drive-in passage leading to the existing or proposed driveway.

A search of the prior art relevant to this type of equipment has revealed the following U.S. patents: U.S. Pat. No. 2,216,971 of 1940 U.S. Pat. No. 2,312,287 of 1943 U.S. Pat. No. 2,441,431 of 1948 U.S. Pat. No. 2,783,789 of 1957 U.S. Pat. No. 3,785,705 of 1974

I have additionally found U.S. Pat. No. 3,649,071 of 1972.

All of the above patents, except U.S. Pat. No. 3,785,705 which relates to a vertically operable saw of no particular interest here, relate to saws that can operate horizontally but that I find ill-adapted and/or not suited for cutting elongated passages through curbstones or sidewalks. This is mostly because the equipment described in these patents does not provide for adequate guide means for the saw. The closest and most pertinent disclosure, in my opinion, is that of U.S. Pat. No. 3,649,071.

The latter however shows a cutting equipment which is located centrally of a wheel-mounted frame attachable to a tractor or a similar vehicle. Now, in use, the wheels of the frame on one side may rest on the street pavement but those on the other side of the frame have to be located on the side of the curbstone or sidewalk where the soil is still in a very uneven condition so that the frame has to be levelled off in order to place the saw in horizontal position. This requires that the four corners of the frame be jacked up, this being of course particularly so for the two corners that stand above the soil which has not been levelled off. Now, in certain cases where the soil is in particularly bad condition, it is not even possible to dispose the cutting saw horizontally.

It is therefore a main object of the invention to provide a machine wherein the cutting equipment is so disposed that all of the cutting work can be done without the machine itself having to straddle the curbstone as with the aforementioned frame.

Another inconvenience in the cutting equipment of U.S. Pat. No. 3,649,071 is that while the saw is mounted so as to be able to cut inclined terminal portions at the ends of the elongated central portion of the access passage, it is not provided to cut an access passage with a central elongated portion having an inclination across either the curbstone or, as the case may be, across the sidewalk. In other words, the sawing machine of the above patent has no provision for cutting an inclined ramp through and across a sidewalk and is in fact not intended for that purpose.

Therefore, a further and additional main object of my invention lies in the provision of a machine with a cutting apparatus of the above general type which is suitable to cut slots through curbstones or sidewalks to provide an access passage that is horizontal or inclined.

Another object of my invention is the provision of such an apparatus wherein the angular adjustment of the cutting saw is easily and positively obtained and held throughout the cutting operation, regardless of the condition of the soil located on the side of the curbstone or sidewall opposite the paved street or road.

A still further object of the invention resides in that the apparatus of my invention has a bridge structure, onto which the saw and its travelling and operating machanisms are mounted, is so constructed as to allow a cutting operation either along a horizontal plane or along an incline of which the angle corresponds to a value set by the local city bylaws. Additionally, however, the saw holding bridge can be made to oscillate about its longitudinal axis so as to vary this predetermined angle where a sidewalk is either narrower or wider than the usual standard width.

Therefore and in accordance with the broad concept of my invention, there is provided and claimed herein a machine which includes a powered truck-like vehicle having a support base at the rear end and an apparatus for cutting a drive-in passage across a concrete curbstone, a sidewalk or the like, the apparatus being mounted on the base and comprising:

- two spaced parallel booms mounted at one end on the base and an elongated bridge structure extending between and perpendicularly to the booms, being connected to them and provided with a drive so that it can be displaced along the booms with respect to the support base of the vehicle;
- means pivoting the booms and bridge structure from an inoperative position where the bridge structure is above the support base to an operative position where the booms and bridge structure are swung outwardly of the support base in a position for cutting a curbstone, sidewalk or the like;
- a carrier having a concrete cutting saw capable of rotating about an axis normal to the carrier;
- means mounting the carrier on the bridge structure and displacing it in a first direction along one face of the structure which is on the side looking toward the support base;
- means mounting the saw on the above-mentioned carrier and for displacing the saw mounting means and the saw along a second direction which is perpendicular to the first mentioned direction. In this manner, with the apparatus in the operative position, the rotary saw is first advanced in the second direction through the curbstone, sidewalk or the like and then in the first direction to cut an elongated slot determining the longitudinal extent of the drive-in passage.

According to a preferred form of the machine, the bridge structure has a central section and, at either end, a terminal section, the terminal sections being each pivotally mounted at one end of the central section and may be driven upwardly so that it can be placed at an incline suitable to displace the carriage and saw along a slope corresponding to the incline for cutting the curbstone, sidewalk or the like to produce the terminal inclined extents of the drive-in passage which join the longitudinal central extent.

Advantageously, the bridge structure may have a second face on the side which looks away from the support base, this second face making a predetermined angle with the one face, turn-table means being provided at the outer ends of the bridge structure to allow the carrier to thus move from one face to the second face, the bridge structure carrier mounting means including, for that purpose, carrier holding means on both faces. Thus, when the carrier rides on the second face, the saw is able to cut through a sidewalk at the predetermined angle.

As aforesaid, and in a further embodiment, the bridge structure is mounted on the booms so that it an oscillate along its longitudinal axis whereby to incline the saw at an angle which is other then the aforesaid predetermined angle.

Other objects and further advantages of the invention will become apparent to those skilled in the art from the following description of a preferred embodiment of the invention having reference to the appended drawings wherein:

FIG. 1 is a perspective view of a machine made according to the invention, including the apparatus for cutting a drive-in passage across a concrete curbstone, sidewalk or the like;

GENERAL DESCRIPTION

A general description of the machine in accordance with this embodiment will first be given to facilitate a better understanding of the various features of the invention.

Figure 1:
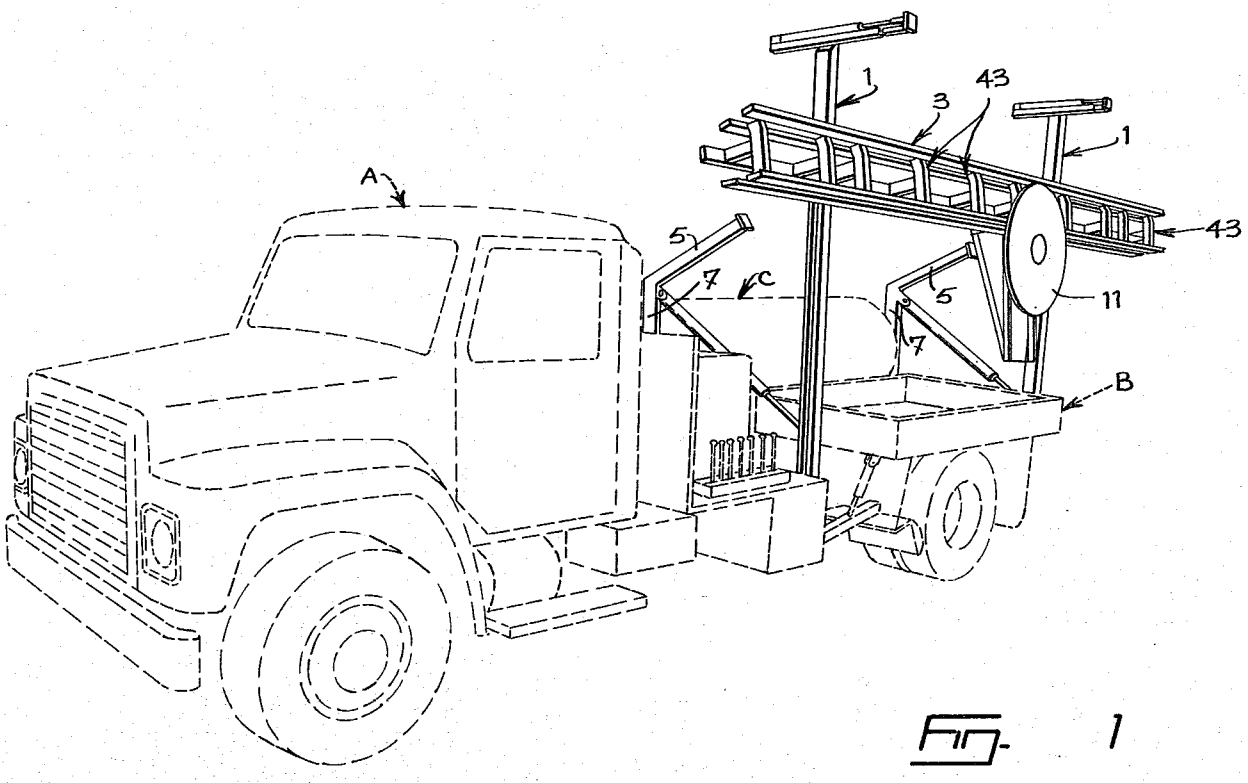

As shown in FIG. 1, the machine is a motor truck having the usual cab A and what is generally to be termed a support base B at the rear which may include a box intended to hold sundry implements useful in the operation of the machine and a fluid pressure reservoir C, being provided along one side of the box B. The pressure fluid may either be air or oil depending on whether pneumatic or hydraulic power jacks are being used to operate the various components of the machine.

Figure 3:
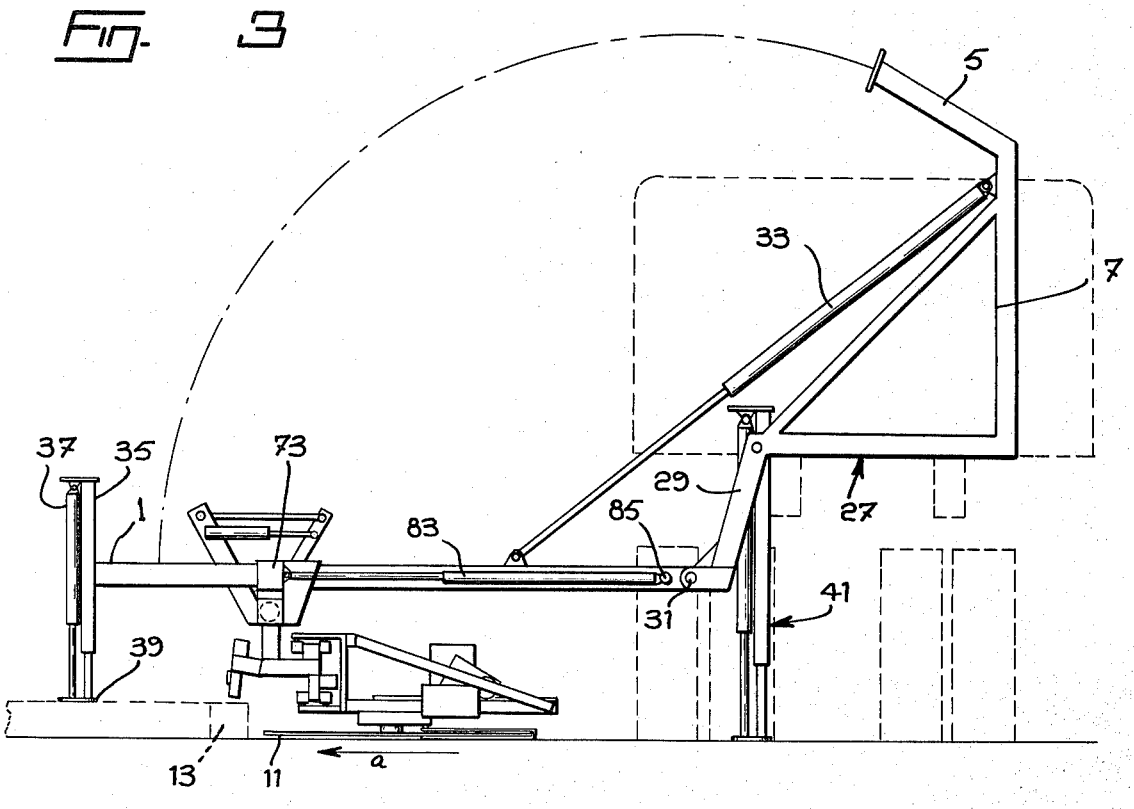
FIG. 3 is a side elevation view of the machine with the saw in position for cutting a horizontal slot.
Figure 4:
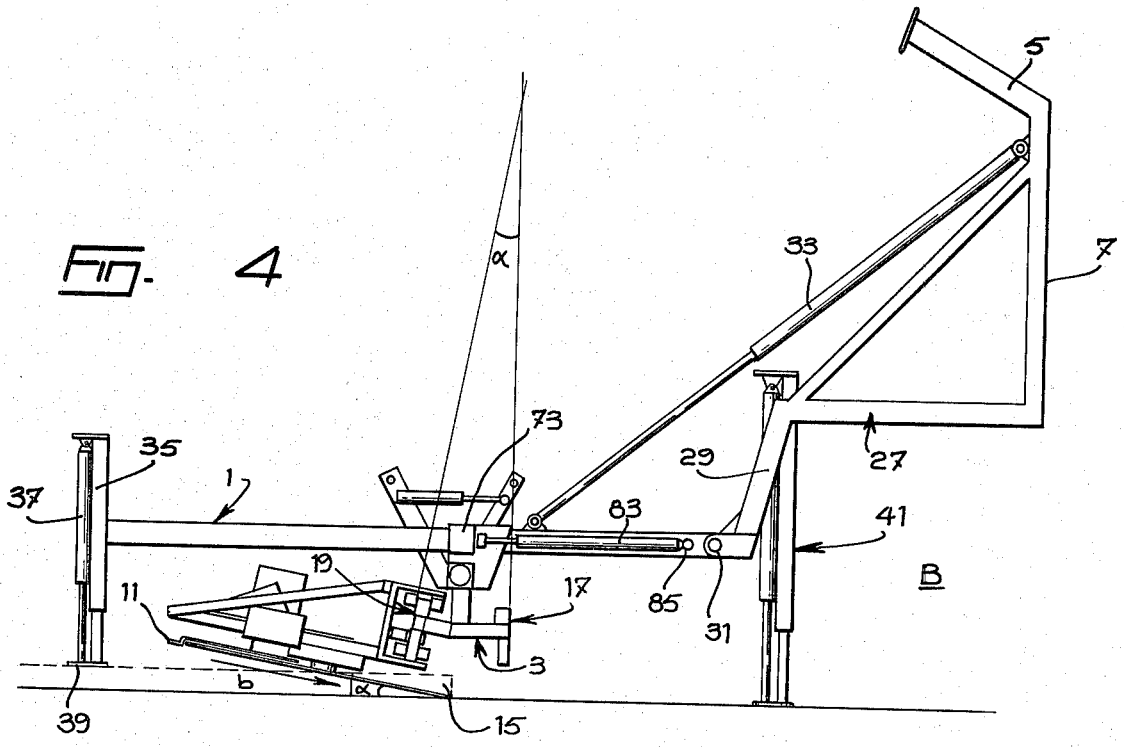
FIG. 4 is a view similar to that of FIG. 3 but showing the saw in position for cutting an inclined slope through a sidewalk.

Two parallel spaced booms 1 are mounted at one of their ends on the base B and an elongated bridge structure 3 extends perpendicularly between the booms 1 being connected to the latter so that it can be displaced bodily along the booms while being kept perpendicular. The booms 1 and the bridge 3 can be pivoted as an assembly from an inoperative position, as shown in FIG. 1, where the bridge 3 stands above the support base B, to an operative position where the boom and bridge structure assembly are swung outwardly of the support base B for cutting a curbstone, sidewalk or the like, as shown in FIGS. 3 and 4.

With particular reference again to the inoperative position of the boom and bridge structure assembly, it is not quite that shown in FIG. 1 but the position where the booms 3 are swung further rearwardly so as to butt against the ends of resting arms 5 that extend from stationary posts 7 projecting upwardly from the support base B.

A carrier 9, having a concrete-cutting saw 11 rotatable about an axis generally normal to the carrier, is mounted on the bridge structure 3 so that it can be displaced along either face 17 or 19 (FIG. 4) of structure 3, this movement being along one way or the other of a first direction of displacement of the carrier and, of course, of the saw 11 mounted thereon.

Provision is also available to displace the saw 11 in a second direction which is perpendicular to the first direction.

With the above general description in mind, when the cutting apparatus stands in the positions of FIGS. 3 or 4, the rotary saw 11 is advanced first in the second direction along arrow a through the curbstone 13, or arrow b through the sidewalk 15, to cut a transverse slot. It is then moved in the first direction to cut a central slot determining the elongated central extent of the drive-in passage. It will be noted, in this respect, that the first face 17 and the second face 19, opposite face 17, make therebetween a predetermined angle $\alpha$ equal to the desired angle of incline of the ramp across the sidewalk 15.

Figure 6:
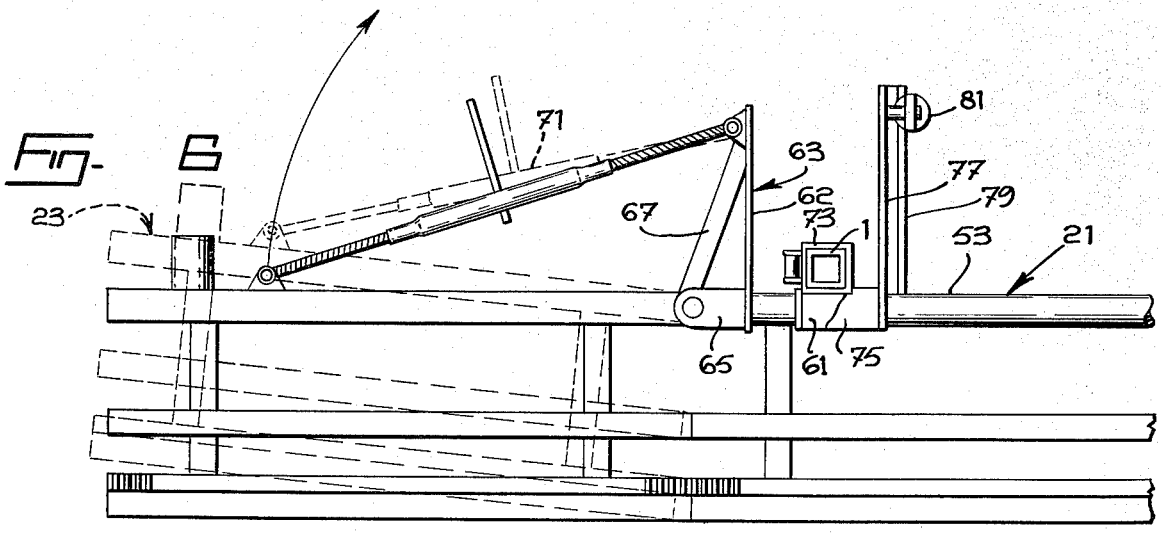
FIG. 6 (third sheet of drawing) is a side elevation view of the terminal bridge structure portion of FIG. 5.
Figure 5:
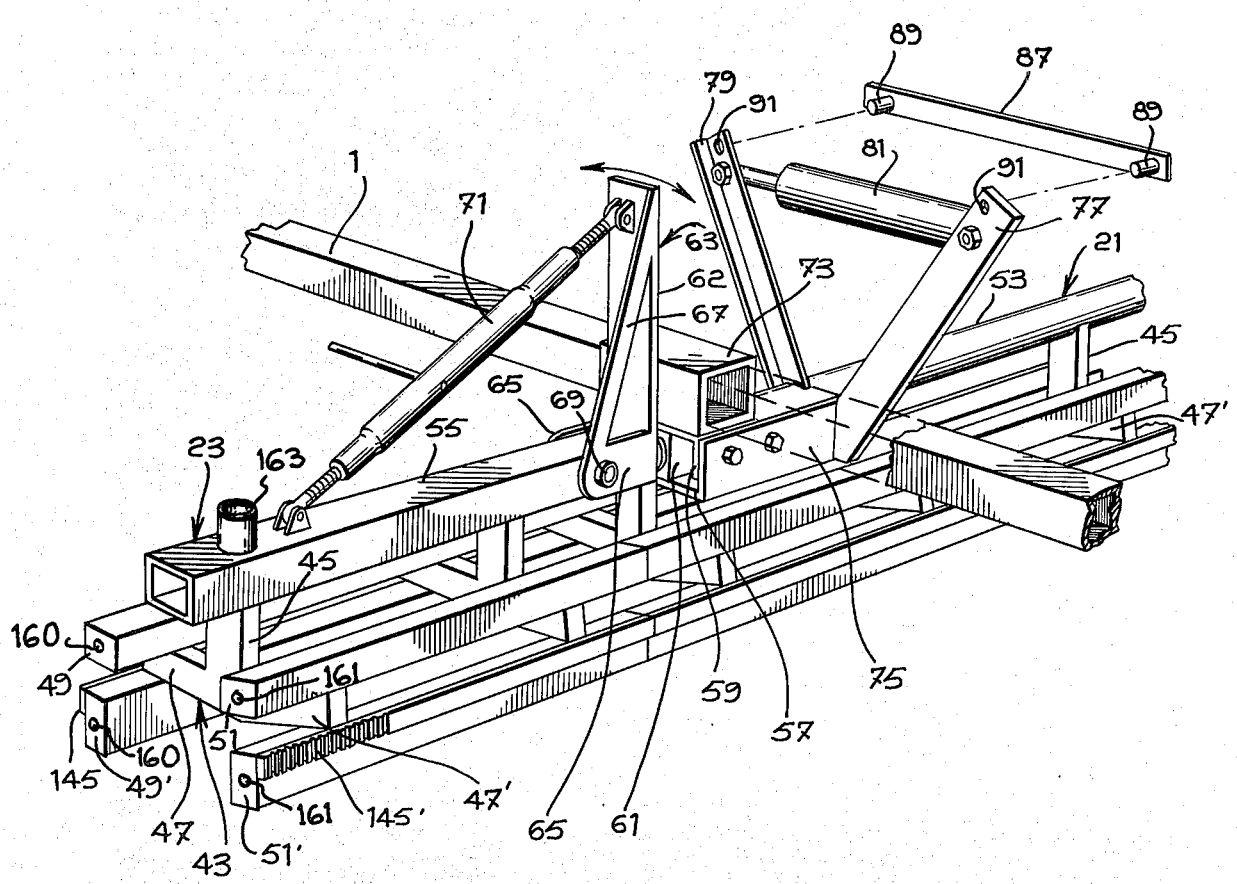
FIG. 5 is a perspective view of one end section of the bridge structure.

The bridge structure 3 is made up of a central section 21 (FIG. 2), essentially between the two booms 1, and terminal sections 23 each on one side of the central section 21 an in the extension thereof. As shown in FIGS. 5 and 6, the sections 23 can be pivoted upwardly with respect to the central section 21 so that by moving the carriage 9 and its saw 11 to the free end of one terminal section 23, the then inclined saw can be driven across the curbstone 13 or sidewalk 15 and then toward the central section 21 to produce an inclined slot joining the central slot of the curbstone sidewalk whereby to produce the terminal or lateral inclined extent of the drive-in passage.

When the inclined slot is finished, the saw is removed, the bridge structure 3 lifted and the terminal section 23 lowered and brought into alignment with the central section 21. The carrier and saw are driven to the other end of the bridge structure and onto the other terminal section 23 where the same operation is made to produce the second terminal cut thereby completing the drive-in passage.

Figure 7:
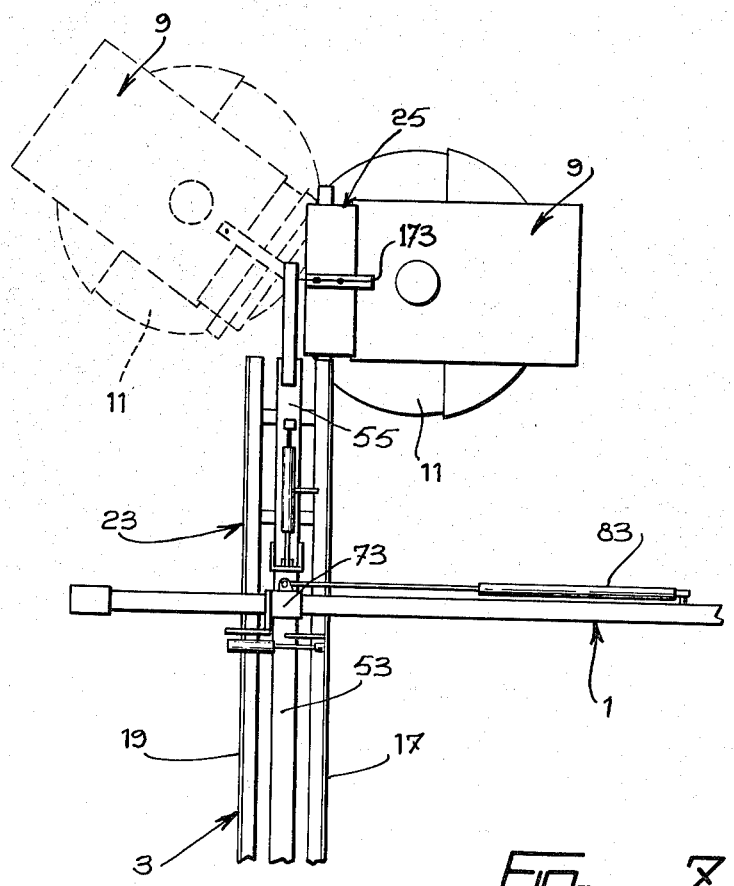
FIG. 7 (fourth sheet of drawing) is a top plan view particularly illustrating one terminal portion of the bridge structure with the turn-table means to allow the carrier to move from one face of the bridge structure to the other.

As shown in FIG. 7, the bridge structure 3 is provided with a turn-table 25 suitable to allow the carrier 9 to move between faces 17, 19.

DETAILED DESCRIPTION

Each boom 1 is pivoted, at 31, to the lower end of a leg 29 which is an integral part of a generally triangular bracket 27 of which the post 7 is one of the side members. Pivotal movement of the two booms 1 is obtained by means of a pair of power jacks 33 (hydraulic or pneumatic) each extending between one post 7 and one boom 1, intermediate the ends thereof. In order that the boom and bridge assembly be swung to operative or inoperative position, it is obvious that the two jacks 33 are to be operated in synchronism.

The free end of each boom 1 is provided with a levelling jack assembly made up of a telescopic standard 35 and a power jack 37, the operating rod of the jack 37 and the sliding rod of the standard 35 being of course connected to the same base plate 39. Similar jack assemblies 41 are provided at either end of the support base B mainly for stabilizing the base and, of course, the relevant end of the boom and bridge structure assembly. As to the jack assemblies 35, 37, they must of course be adjusted according to the level condition of the lot on which the base plates 39 lie, on the side of the curb 13 or sidewalk 15 opposite the paved road or street on which the jack assemblies 41 are set. In either the case of FIG. 3 or FIG. 4, the intent is to place the booms 1 into a generally horizontal common plane.

Referring now particularly to FIGS. 1 and 5, the central section 21 of the bridge structure 3 is made up of a series of inverted T cores 43 each having a central stem 45 and a pair of lateral bars 47, 47' extending in opposite directions from the stem 45 and making between them an angle which is supplementary to the previously mentioned angle $\alpha$, particularly shown in FIG. 4. On the face 17 of the bridge structure 3, there are provided top and bottom elongated rail members 49, 49' secured over the top and bottom surfaces of the lateral bars 47. In a similar manner, on the second face 19 of the bridge 3, there are provided a pair of elongated rails 51, 51' secured respectively on the top and bottom surfaces of the lateral bars 47'. The arrangement is such that the outer faces of the rails 49, 49' lie in a common first plane and the outer faces of the rails 51, 51' lie in a common second plane, the first and second planes making the aforesaid angle $\alpha$, as best illustrated in FIG. 4. Finally, the ends of the central stems 45 are connected to a longitudinal elongated cylindrical bar 53, in the case of the central section 21. On the other hand, the said ends of the central stems 45 are, in the case of the terminal sections 23, fixed to square hollow bars 55.

Corresponding to each end of the central section 21 is a bearing structure for the cylindrical bar 53. This structure is made up of a pair of channel members 57, 59 secured together to define an inner housing inside of which there is fixed a square bearing block 61 having a central through bore into which the relevant end of the cylindrical bar 53 journals. As best illustrated in FIG. 6, the cylindrical bar 53 extends beyond the bearing block 61 and its transverse flat radial face is secured to the lower end of an upstanding web 62 which is part of an L-shaped bracket 63 having a pair of spaced lugs 65 of which one is connected to the web 62 by means of a brace 67. The spaced lugs 65 straddle the square hollow bar 55 of the relevant terminal section 23 of the bridge structure 3, being connected thereto by a pivot 69 which can be of the bolt and nut type. It should be pointed out here that the square bar 55 is integral part of the terminal section 23 which is identical in construction to the central section 21 except that the top member is a square hollow bar 55 as opposed to the cylindrical bar 53 of the central section 21. To be noted also is the fact that the said cylindrical bar 53 is secured to the back of the web 62 of the bracket 63 but the square bar 55 is not, so that, by means of a conventional power jack such as 71 in FIG. 5, the terminal section 23 may be angularly displaced with respect to the central section 21.

Channel 59 has the web thereof fixedly secured to the bottom of a square sleeve 73 slidably mounted on the relevant boom 1 of likewise square cross-section so as to be freely insertable into the sleeve 73. Note should be taken here that the web 62 of the bracket 63 is not secured to the side of this sleeve 73, as clearly illustrated in FIG. 6.

One flange 75 of channel 57 extends beyond the sleeve 73, as best shown in FIG. 5. To the outer end of this flange 75 is secured an operating lever 77 facing a like lever 79 of which one end is secured to the cylindrical bar 53 of the bridge structure central section 21. The upward ends of the operating levers 77, 79 are interconnected by a power jack 81.

Whenever power jack 81 is operated, let us say shortened, the operating lever 77 stays stationary as it is ultimately connected to the sleeve 73 of the boom 1 while the lever 79 causes clockwise rotation of the cylindrical bar 53 as well as like rotation of the terminal section 23 since the latter is solid, in this respect, with the central section 21 through its connection to the L-shaped bracket 63 secured to the end of the cylindrical bar 53.

As aforesaid, the advantage of this construction is to place the saw 11 at an angle other than the predetermined angle $\alpha$ between the faces 17 and 19 where the sidewalk is either narrower or wider than conventional sidewalks. Also, this possibility of oscillating the bridge structure 3 may be found useful as a final adjustment of the saw 11 where its levelling may not be fully attained by the use of the jack assemblies 35, 37 in view of the poor level condition of the lot inside the curbstone or sidewalk.

Figure 2:
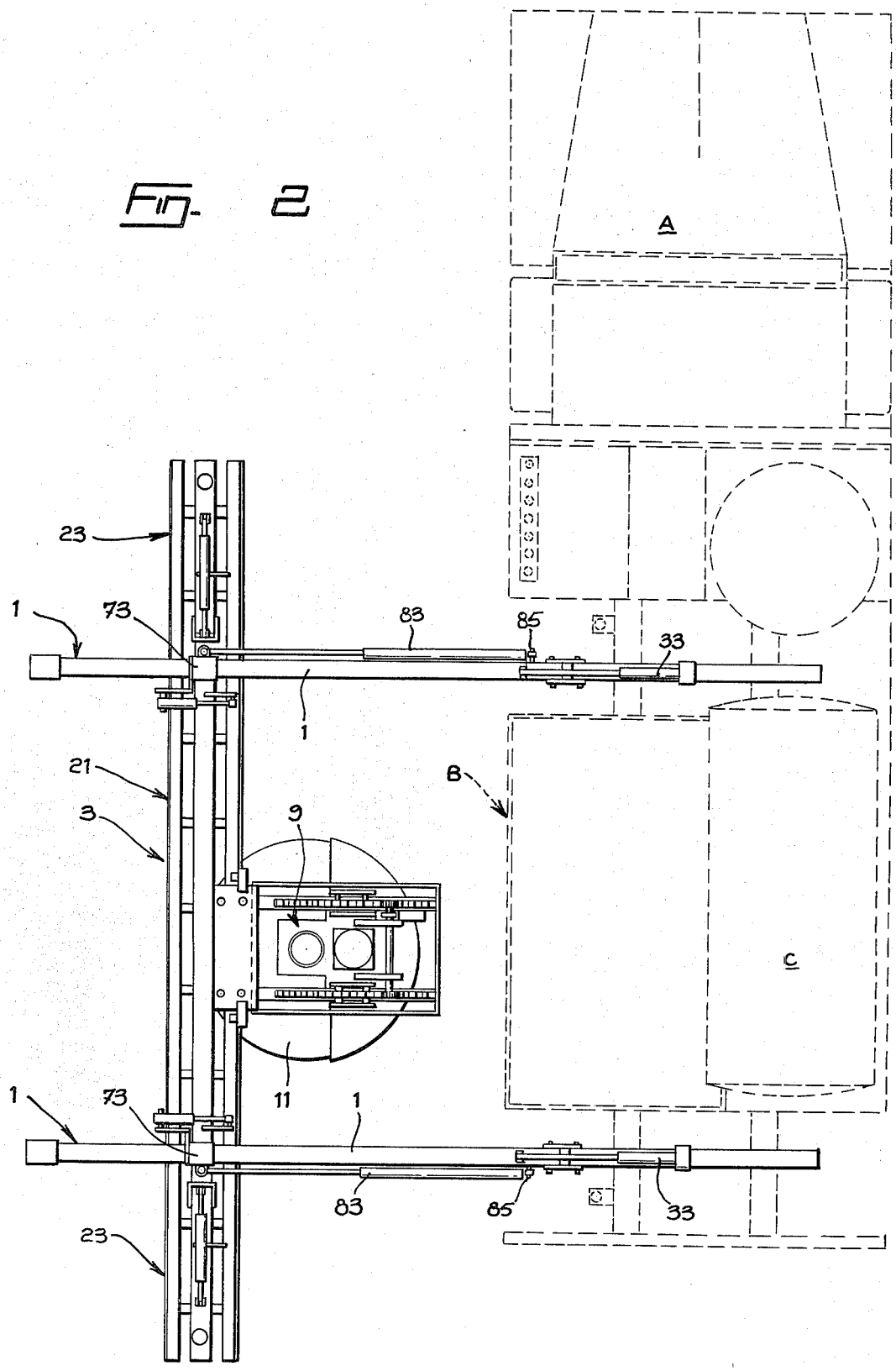
FIG. 2 is a top plan view of the machine of FIG. 1.

Referring now to FIGS. 2, 4 and 7, bodily displacement of the bridge structure 3 along the booms 1 is obtained by means of a pair of synchronously operated jacks 83 of which one end is connected to the sleeves 73 and the other ends to pivots 85 on the booms 1, located adjacent to the pivots 31 of the said booms.

Referring to FIG. 5, it is pointed out that the operating levers 77, 79 will normally be held apart by a lock bar 87 having laterally projecting pins 89 at the ends thereof insertable into receiving holes 91 at the outer ends, respectively, of the operating levers 77, 79. When the levers 77, 79 are so set, the faces 17 and 19 of the bridge structure 3 (FIG. 4) will make the aforesaid angle $\alpha$. When this angle has to be changed, the lock bar 87 is removed and the levers 77, 79 operated to place the saw 11 at the selected angle at which time the levers 77, 79 may be locked again in any suitable ways.

Figure 8:
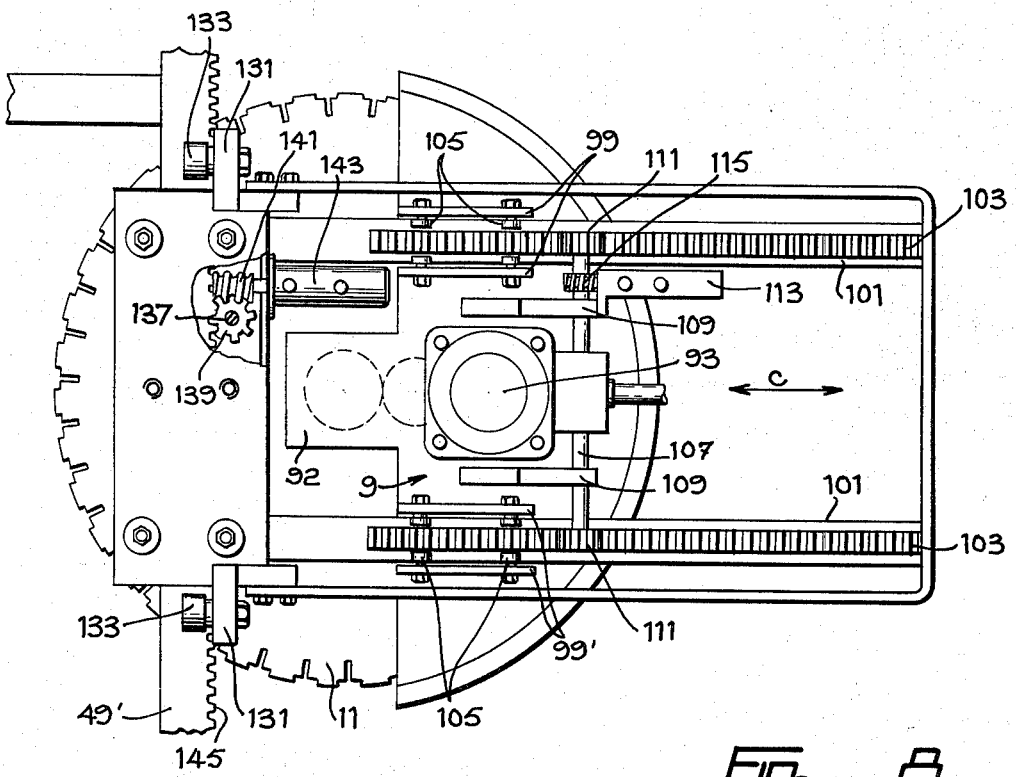
FIGS. 8 and 9 are, respectively, a top plan view and a side elevation view of the saw carrier structure shown mounted on the partially illustrated bridge structure.
Figure 9:
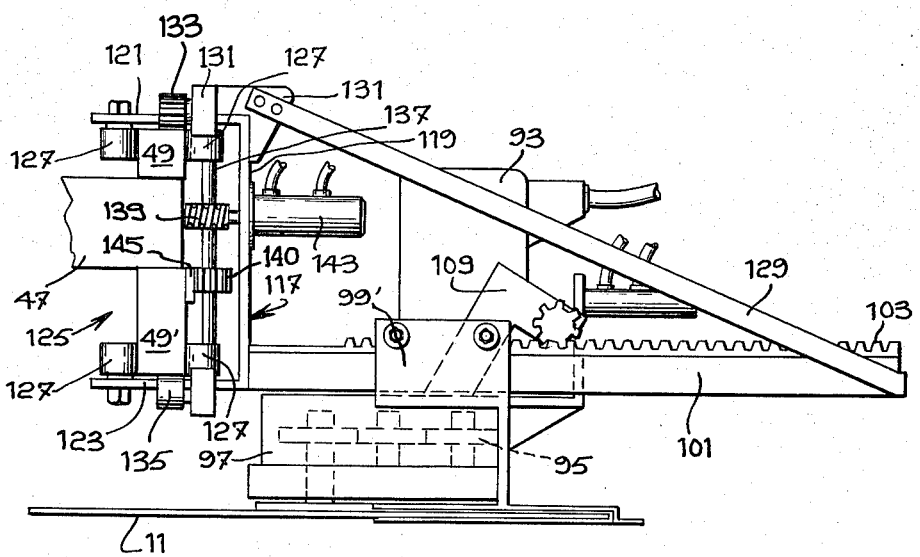

Referring now to FIGS. 8 and 9, the carrier 9 has a generally T-shaped platform 92 over which is mounted a hydraulic or pneumatic motor 93 driving the saw 11 through a gear transmission 95 (FIG. 9) contained in a housing 97 fixed to and depending from beneath the platform 92.

Along the edges of the platform 92, there are provided two pairs of spaced flanges 99, 99' defining therebetween passages into which are received two rails 101 over the top of which are provided racks 103, the rails 101 and their racks 103 being part of the means for mounting the carrier 9 and its equipment on the bridge structure 3.

Within the aforesaid passages between the flanges 99, 99' are provided a series of pairs of rollers 105 pivotally mounted, in any known manner, on the said flanges 99, 99'. These rollers 105 are so located as to ride on the rails 101, on either side of the racks 103 thereby providing a means of allowing displacement of the carrier 9 and its equipment along a second direction which is perpendicular to the first direction mentioned above corresponding to the longitudinal direction of the bridge structure 3.

Means are of course provided to allow the said carrier displacement in the second direction, along arrow c. Such means, as shown particularly in FIGS. 8 and 9, comprises a rotary axle 107 supported by a pair of brackets 109, disposed on either side of the previously mentioned motor 93, being secured to and upstanding from the central platform 92 of the carrier 9. Rotary pinions 111 are provided at the ends of the axle 107 and are in mesh with the respective racks 103 of the rails 101. A further motor 113, mounted on one of the brackets 109, drives a worm 115 in mesh with a gear (not shown) fixed to the axle 107.

It will thus be understood that operation of the motor 113 causes, through the worm and gear arrangement aforesaid, rotation of the axle 107 and pinions 111 thereby causing displacement of the carrier 9 and its equipment along the said second direction.

As mentioned above, the rails 101 are part of the means for mounting the carrier 9 on the bridge structure 3. Such means further comprises a channel-shaped bracket 117 having a web 119, parallel to the first face 17 of the bridge structure 3, and two flanges 121, 123, this bracket 117 thus defining an inner chamber 125 into which the rails 49, 49' are disposed. On either side of the latter rails 49, 49', are rollers 127 mounted for free rotation on the flanges 121 and 123, within the housing 125. These rollers are mounted so as to ride freely on the opposite faces of the upper and lower rails 49, 49', the latter rails thus constituting means for holding the mounting means on the bridge structure 3.

It will be noted that the rails 101 are secured, at one end, at the lower end of the web 119 of the bracket 117, being further braced into position by inclined struts 129 connected at one end to the outer ends of the rails 101 and, at the other end, to brackets 131 secured at the upper end of the web 119. As shown, additional rollers 133, rotatably mounted on the said brackets 131 are adapted to ride on the top surface of the top rail 49 whereas bottom rollers 135, similarly mounted at the bottom of the bracket 117, freely ride on the bottom surface of the lower rail 49'.

The means for driving the aforesaid channel assembly in the first direction along the bridge structure 3 includes a shaft 137 (FIG. 9) mounted for rotation within chamber 125 and on the top and bottom flanges 121, 123. On this shaft 137 is fixed a gear 139 (FIG. 8) in mesh with a worm 141 driven by a motor 143 (hydraulic or pneumatic) secured outwardly of and on the web 119. A further gear 140 is mounted on the shaft 137 and at the lower end thereof which meshes with a rack 145 provided on the outer face of the lower rail 49' (see FIG. 5).

When the motor 143 is energized, it drives the shaft 137 into rotation which consequently rotates the lower gear 140 which is in mesh with the rack 145 thereby causing displacement of the bracket 117 and the equipment connected thereto including the carrier 9 and the saw 11.

Thus, there has been provided means for displacing the saw in the said first direction, along the bridge structure 3, and the second direction which is perpendicular to the first direction by having the carrier 9 move along the rails 101.

As pointed out above, the upper and lower rails 49, 49' of the bridge structure 3 constitute a holding means for retaining the bracket 117 thereon with its rolling equipment and, as a consequence, the rails 101 and the carrier 9 and the equipment mounted thereon.

The same holding means is provided on the face 19 of the bridge structure 3, opposite the first face 17, in the form of the previously mentioned upper and lower rails 51, 51' (FIG. 5). The said lower face 51' further has a rack 145' allowing the displacement of the bracket 117 and its assembly. In order that the carrier 9 and the carrier mounting means can be moved from face 17 to face 19 and vice versa, use is made of the aforementioned turn-table 25 (FIG. 7).

Figure 10:
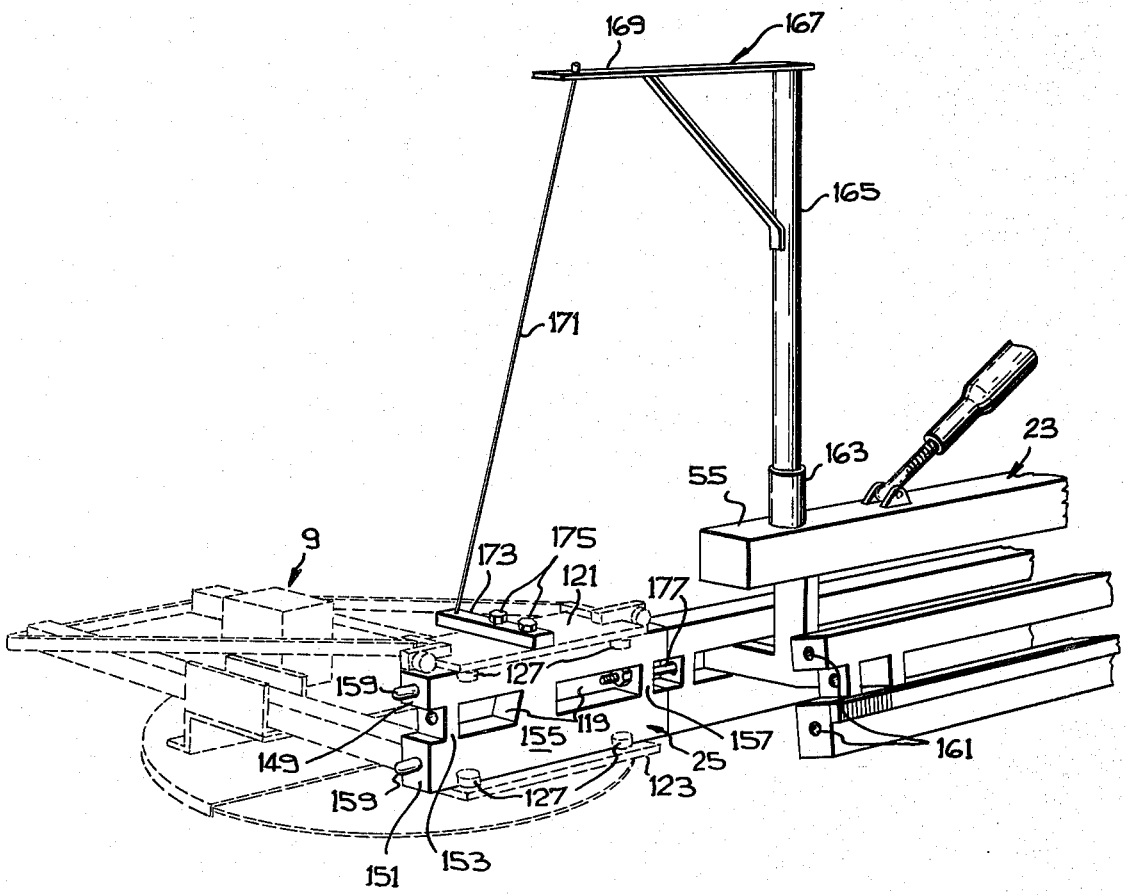
FIG. 10 is a perspective view of the carrier and turntable.

This turn-table takes the form of a short half section of bridge structure 3. It is made up of a pair of horizontal parallel rails 149 and 151 (FIG. 10) of the same cross-section and same vertical spacing as rails 49, 49' (or 51, 51') and integrated together by vertical spacing stems 153,155 and 157. Connecting pins 159 project from the terminal faces of the rails 149, and 151, at either end thereof. These are intended to fit into receiving bores 160 (FIG. 5) and 161. As illustrated in FIG. 10, the turn-table 25 is constructed to fit selectively at the end of the rails 49, 49' or 51, 51' so that the rails 149, 151 may constitute continuations thereof, allowing the carrier 9 to be moved on the turn-table 25. Shifting of the turn-table 25, with carrier 9 thereon, is obtained by the following transfer assembly.

The latter is constituted by a cylinder base 163, secured to the square bar 55 of the terminal section 23, into which fits the post 165 of a jib 167 having a horizontal arm 169 at the end of which one end of a rope 171 hangs. The other end of the rope 171 is secured to a support bar 173 removably secured by screws 175 on top of the flange 121 of the channel bracket 117 (FIG. 9). Normally, the turn-table 25 is secured at the end of terminal portion by a bolt and nut assembly 177.

When the carrier 9 is to be moved from face 17 to face 19 of the bridge structure 3, the bar 173 is secured on the flange 121; the lower end of the cable 171 fixed to the bar 173 (in any known manner) the bolt and nut assembly 177 removed and the turn-table 25, with the carrier 9 thereon, pulled manually to be freed from the terminal section 23. It is then rotated by 180, again manually, and the connecting pins 159 inserted in the relevant bores 161 of the face 19. The bolt and nut assembly 177 is thereafter mounted to secure the turn-table 25 in the extension of face 19.

I claimed:

1. A machine including a powered truck-like vehicle having a support base at the rear and an apparatus mounted thereon for cutting a drive-in passage across a concrete curbstone, a sidewalk or the like, said apparatus comprising:

two spaced parallel booms mounted at one end on said base and an elongated bridge structure extending between said booms perpendicularly thereto and connected to said booms for displacement therealong relative to said one end of said booms, and means for displacing said structure along said booms, means pivoting said booms and bridge structure together from an inoperative position where said bridge structure stands above said support base to an operative position where said booms and bridge structure are swung outwardly of said support base for cutting a curbstone, sidewalk or the like;

a carrier having a concrete-cutting rotary saw thereon for rotation about an axis generally normal to said carrier, and means mounting said saw on said carrier;

means mounting said carrier on said bridge structure for displacement thereof in a first direction along one face of said bridge structure, and means for displacing said carrier in said first direction;

means on said carrier mounting means, for displacing said carrier in a second direction perpendicular to said first direction;

whereby, with said apparatus in said operative position, said rotary saw is advanced first in said second direction through said curbstone, sidewalk or the like, and then in said first direction to cut an elongated slot determining the longitudinal extent of said drive-in passage, wherein said bridge structure has a central section and, at either end thereof, a terminal section; means pivotally mounting said terminal sections at the ends of said central section and means pivoting said terminal sections upwardly with respect to said central section selectively to place said terminal sections at an incline suitable to displace the said carriage and saw along a slope corresponding to said incline for cutting said curbstone, sidewalk or the like whereby to produce terminal inclined extents for said drive-in passage, said inclined extends joining said longitudinal extent.

2. A machine as claimed in claim 1, wherein said bridge structure has a second face, opposite said first face and looking away from said support base, said second face making a predetermined angle with said one face; turn-table means at the outer ends of said bridge structure terminal sections to allow said carrier mounting means with said carrier thereon to move from said one face to said second face, said carrier mounting means including carrier holding means on both said one face and said second face, said carrier holding means being suitable to hold said saw, when on said second face, to cut through a sidewalk at said predetermined angle.

3. A machine as claimed in claim 2, including further means mounting said bridge structure on said booms for oscillation of said bridge structure along its longitudinal axis whereby to incline said saw at an angle other than said predetermined angle.

4. A machine including a powered truck-like vehicle having a support base at the rear and an apparatus mounted thereon for cutting a drive-in passage across a concrete curbstone, a sidewalk or the like, said apparatus comprising:

two spaced parallel booms mounted at one end on said base and an elongated bridge structure extending between said booms perpendicularly thereto and connected to said booms for displacement therealong relative to said one end of said booms, and means for displacing said structure along said booms;

means pivoting said booms and bridge structure together from an inoperative position where said bridge structure stands above said support base to an operative position where said booms and bridge structure are swung outwardly of said support base for cutting a curbstone, sidewalk or the like;

a carrier having a concrete-cutting rotary saw thereon for rotation about an axis generally normal to said carrier, and means mounting said saw on said carrier;

means mounting said carrier on said bridge structure for displacement thereof in a first direction along one face of said bridge structure, and means for displacing said carrier in said first direction;

means, on said carrier mounting means, for displacing said carrier in a second direction perpendicular to said first direction;

whereby, with said apparatus in said operative position, said rotary saw is advanced first in said second direction through said curbstone, sidewalk or the like, and then in said first direction to cut an elongated slot determining the longitudinal extent of said drive-in passage wherein said bridge structure has a second face, opposite said first face and looking away from said support base, said second face making a predetermined angle with said one face; turn-table means at the outer ends of said bridge structure to allow said carrier mounting means with said carrier thereon to move from said one face to said second face, said carrier mounting means including carrier holding means on both said one face and said second face, said carrier holding means being suitable to hold said saw, when on said second face, to cut through a sidewalk at said predetermined angle.

5. A machine as claimed in claim 4, including further means mounting said bridge structure on said booms for oscillation of said bridge structure along its longitudinal axis whereby to incline said saw at an angle other than said predetermined angle.

6. A machine as claimed in claims 5 or 3, including jack means at the ends of said booms, away from said support base, to adjust the position of said booms, bridge structure and saw carrier with respect to the top face of said curbstone, sidewalk or the like to be cut.

7. A machine including a powered truck-like vehicle having a support base at the rear and an apparatus for providing a drive-in passage across a concrete curbstone, sidewalk or the like, said apparatus being mounted on said base and comprising:

two parallel spaced booms mounted at one end on said base and an elongated bridge structure extending between said booms perpendicularly thereto and connected to said booms for displacement therealong relative to said one end of said booms, and means for displacing said bridge along said booms;

means pivoting said booms and bridge structure together from an inoperative position where said bridge structure stands above said support base to an operative position where said booms and bridge structure are swung outwardly of said support base for cutting a curbstone, sidewalk or the like;

a carrier having a concrete-cutting rotaty saw thereon, means causing rotation of the said saw about an axis generally normal to said carrier, and means mounting said saw on said carrier;

means mounting said carrier on said bridge structure for displacement thereof in a first direction along one face of said structure, and means for displacing said carrier in said first direction;

means, on said carrier mounting means, for displacing said carrier in a second direction perpendicular to said first direction;

whereby with said apparatus in said operative position, said rotary saw is advanced first in said second direction through said curbstone, sidewalk or the like, and then in said first direction to cut an elongated slot determining the longitudinal extent of said drive-in passage;

wherein said bridge structure has a central section and, at either end thereof, a terminal section; means pivotally mounting said terminal sections at the ends of said central section and means pivoting said terminal sections upwardly to place same at an incline to displace the said carrier and saw along a slope corresponding to said incline for cutting said curbstone, sidewalk or the like, to produce terminal inclined extents joining said longitudinal extent;

wherein said bridge structure has a second face thereof looking away from said support base, said second face making a predetermined angle with said one face; turn-table means at the outer ends of said bridge structure terminal sections to allow said carrier to move from said one face to said second face; said means mounting said carrier on said bridge structure including carrier holding means on both said one face and said second face suitable to hold said carrier and saw, when on said second face, to allow said saw to cut through a sidewalk at said predetermined angle; and means mounting said bridge structure on said booms for oscillation of said bridge structure along its longitudinal axis whereby to incline said saw at an angle other than said predetermined angle.

8. A machine as claimed in claim 7, wherein said booms and bridge structure are connected together by a pair of sleeves solid with and extending transversely of said bridge structure, said sleeves being slidably mounted around booms, respectively; said bridge displacing means comprising a pair of power jacks, each parallel to one of said booms and connected at the respective ends to said bridge structure and to said booms adjacent said support base.

9. A machine as claimed in claim 8, wherein said power jacks have one end connected to said sleeves which are solid with said bridge structure.

10. A machine as claimed in claim 8, wherein said bridge structure includes an elongated cylindrical member at the top thereof ending short of said terminal sections, and said means mounting said bridge structure on said booms for oscillation comprises: bearing means secured to each of said sleeves and having bearing bores into which the ends of said cylindrical member freely journal, and at least one pair of arms secured to and radially projecting from one end of said cylindrical member and the adjacent bearing means whereby relative displacement of said arms causes oscillation of said bridge structure.

11. A machine as claimed in claim 10, wherein each terminal section of said bridge structure has a top elongated terminal member; said means pivotally mounting said terminal sections at the ends of said central section comprises: brackets fixed to and each radially projecting from one end of said cylindrical section, and means mounting adjacent ends of said terminal members on said brackets for pivotal movement about axes transverse of said terminal members, and wherein said means pivoting said terminal sections are jacks having the ends thereof pivoted to said terminal members and to said brackets at points away from the pivot axes thereof.

12. A machine as claimed in claim 7, wherein said means pivoting said booms and bridge structure between said positions are a pair of power jacks, each having one end connected to one of said booms and the other end connected to said support base at a point thereof away from and above the end of said boom connected to said support base.

13. A machine as claimed in claim 7, wherein said carrier holding means comprises, along each of said faces of said bridge structure, an elongated upper rail and a parallel elongated lower rail, and wherein said means mounting said carrier on said bridge structure comprises:

a channel-shaped bracket having a web parallel to said one face and flanges projecting from the ends of said web in a direction away from said support base, said bracket defining an inner chamber; rollers and means mounting said rollers on said bracket, inside said chamber, for free rotation about axes parallel to said web, and arranged to ride on opposite lateral faces of said upper and lower rails; additional rollers, and means mounting said additional rollers on said bracket outside of said chamber, for free rotation about axes perpendicular to said web, and arranged to ride respectively on the top face of said top rail and the bottom face of said bottom rail.

14. A machine as claimed in claim 13, wherein said means displacing said carrier in said first direction comprises:

a rack provided along one of said rails and a pinion in mesh with said rack;

a shaft mounted in said chamber for free rotation about an axis parallel to said web of said bracket and means securing said pinion on said shaft, and motor means on said bracket causing rotation of said shaft and pinion to move said bracket and carrier along said one direction.

15. A machine as claimed in claims 13 or 14, wherein said means mounting said carrier on said bridge structure further comprises: a pair of spaced tracks secured to and projecting perpendicularly from said web of said bracket and each track having an elongated rack along the upper surface thereof, wherein said carrier comprises a central platform and roller means along lateral edges including rollers freely rotatable on said tracks; two pinions each in mesh with one of said racks and motor means on said carrier platform to drive said pinions on said racks to move said carrier along said second direction, and wherein said means mounting said saw on said carrier includes a second motor means on said carrier platform operatively connected to said saw to bring it into rotation.

* * * * *